United States Patent [19]

Saarivirta et al.

[11] 4,238,635

[45] Dec. 9, 1980

[54] MELTING AND CASTING MEANS

[76] Inventors: Matti Saarivirta, P.O. Box 794, Marquette, Mich. 49855; Kalervo Lahtinen, Palokunnanpuistokatu 40, 28120 Pori 13, Finland

[21] Appl. No.: 78,569

[22] Filed: Sep. 24, 1979

Related U.S. Application Data

[63] Continuation-in-part of Ser. No. 803,157, Jun. 3, 1977, abandoned.

[30] Foreign Application Priority Data

Jun. 10, 1976 [FI] Finland ..... 761661

[51] Int. Cl.[3] ..... H05B 3/00

[52] U.S. Cl. ..... 13/22; 219/421

[58] Field of Search ..... 13/20, 22, 25, 35; 219/421, 426

[56] References Cited

U.S. PATENT DOCUMENTS

| | | | |
|---|---|---|---|
| 3,181,845 | 5/1965 | Malm et al. | 13/22 X |
| 3,431,345 | 3/1969 | Faulkner et al. | 13/22 |
| 3,436,524 | 4/1969 | Pauls | 13/22 X |
| 3,768,790 | 10/1973 | Landt et al. | 13/22 X |
| 4,011,394 | 3/1977 | Shelley | 13/20 |

*Primary Examiner*—Roy N. Envall, Jr.
*Attorney, Agent, or Firm*—Woodling, Krost & Rust

[57] ABSTRACT

The invention concerns a melting and casting means. The means comprises a heating chamber confined by side, top and bottom walls made of insulating material and enclosed by a steel shell. Mounted in the chamber are a crucible stand and upon said stand a crucible. According to the invention, the means further comprises at least three silicon carbide heating elements for heating the crucible to between 1100° and 1650° C. to the purpose of melting copper and copper alloys, and the insulating material mainly consists of aluminium oxide and silicon oxide fibres. The heating elements have been disposed in the chamber so that the distance between the element center and the outer wall of the crucible is 2 to 4 times the element diameter. The elements are advantageously disposed horizontally piercing the side walls of the means, and they have no contact with the bottom wall. The spacing of the heating elements from the inner wall of the chamber is advantageously 2 to 4 times the element diameter. The thermal conductivity of the thermally insulating material is about 0.1–0.3 kcal/m h °C. at 400° C. and respectively 1200° C.

8 Claims, 6 Drawing Figures

MELTING AND CASTING MEANS

Figure 1:
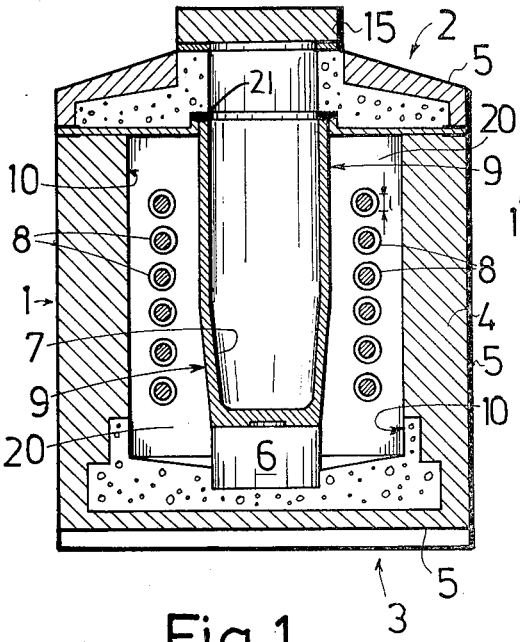

This is a continuation-in-part of Ser. No. 803,157 filed June 3, 1977, now abandoned.

The present invention concerns a melting and casting means.

Nowadays known in the art are melting furnaces with oil heating, induction furnaces, and melting furnaces heated with the aid of electrical resistances.

Oil-heated melting furnaces are uneconomical: when oil is used for melting e.g. copper, the oil consumption is about 0.5 kg oil per 1 kg copper. Moreover, oil furnaces cause pollution of air with their smoke generation. Use of oil furnaces implies that smoke elimination and ventilation are taken care of.

Induction furnaces also are uneconomical: when a coreless induction furnace is being used e.g. to melt copper, the consumption of electricity is about 0.4 kWh per kg of copper. Induction furnaces command high manufacturing costs and therefore a high initial price. Furthermore, the molten metal in an induction furnace is susceptible to agitation and therefore to oxidation.

In prior art resistance furnaces are also known, but they fail to reach the relatively high temperatures required by copper and copper alloy melting. Furthermore, the resistance furnaces of prior art are unsatisfactory as regards their structural design and their strength and durability properties resulting from their design; it is particularly noted that the life span of the crucibles is short and the heat economy is unfavourable.

The object of the present invention is to provide a melting and casting means which is usable in the melting of copper and copper alloys within the temperature range from 1100° to 1650° C. It is furthermore an object of the invention, to provide a melting and casting means which is simple of its structural design and advantageous of its operating costs. It is further an object of the invention, to provide a melting and casting means with a longer life span than means of prior art, as regards the crucible, the inner wall of the heating chamber and the resistance elements.

Regarding the characteristic feature of the invention, reference is made to the claims.

According to the present invention, silicon carbide heating elements are used in the temperature range from 1100° to 1650° C.

The invention is based on use of mineral fibres for lagging material in the melting and casting means. In prior art, the thermal lagging of melting furnaces has been constructed of rather considerably heavier and less efficiently heat-insulating lagging materials, such as ceramic materials, refractory bricks, etc.

The invention is furthermore based on placement of the resistance elements at a given distance from the crucible, whereby maximal radiant power is achieved without exposing the crucible to excessive thermal stress.

The invention is furthermore based on solid structural design, which prevents the release of metal vapours from the crucible into the heating chamber. The heating elements will not be exposed to metal vapours and their life span is longer.

With a view to increasing the life span of the heating elements, the elements may advantageously be installed horizontally, piercing the opposite walls of the heating chamber and spaced at a given distance from the bottom wall of the chamber. Hereby the mechanical shocks due to the use of the melting and casting means will not cause breakage of elements; moreover any molten that may run down on the bottom of the heating chamber cannot damage the elements. The elements may further be disposed at a given distance from the inner wall of the chamber, which prevents the walls from being exposed to too high thermal loads. By the melting and casting means of the invention an energy consumption level has been attained which is only half of that of induction furnaces known in the art. Compared with an oil furnace, the energy consumption in the furnace of the invention is about one-fifth of that of an equivalent oil furnace, when melting copper. The melting and casting means of the invention is eminently suited for the melting of copper and copper alloys within the temperature range 1100-1150-1200-1250-1600-1650° C.; the furnace may moreover be used in the melting of other metals, such as aluminum, at lower temperatures, e.g. down to 700° C.

Figure 2:
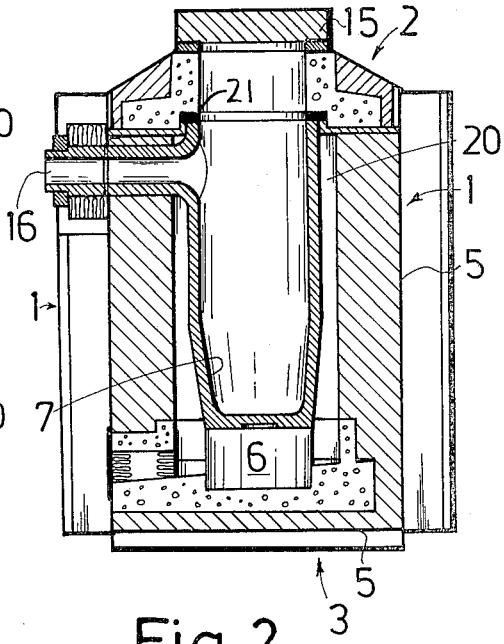

The invention shall be described in detail in the following, with the aid of embodiment examples and with reference to the attached drawings, wherein:

FIG. 1 presents, viewed from the front, the heating chamber of a tiltable furnace according to the invention, sectioned, FIG. 2 shows the same heating chamber as FIG. 1, now in elevational view from one side.

Figure 3:
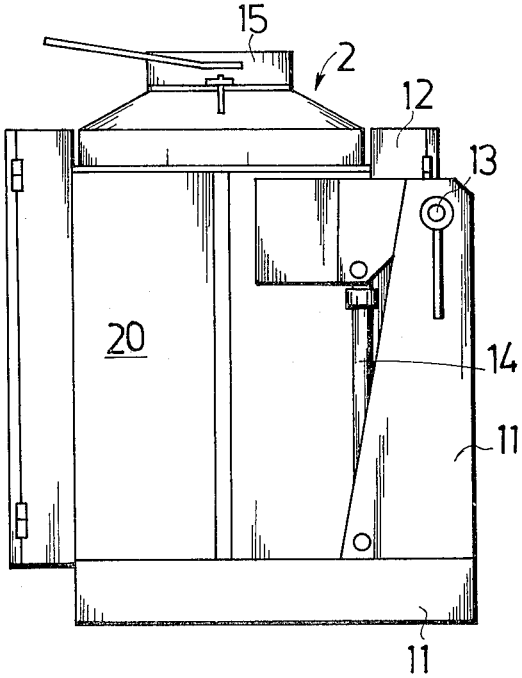
Figure 4:
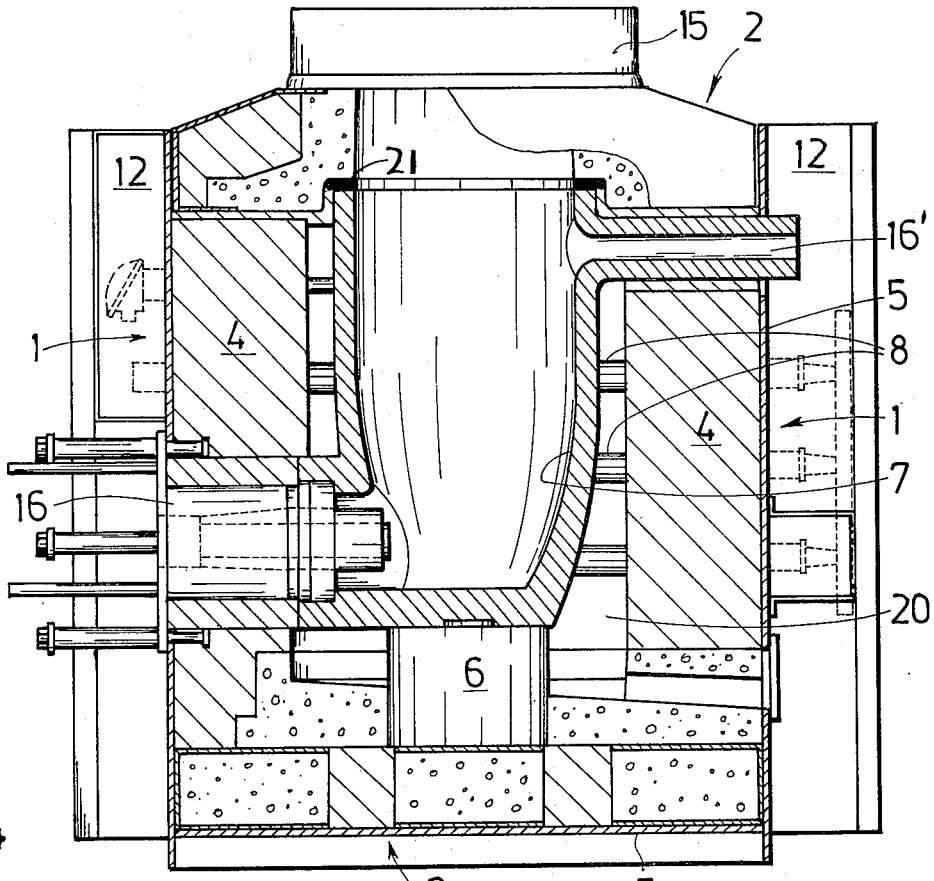
Figure 5:
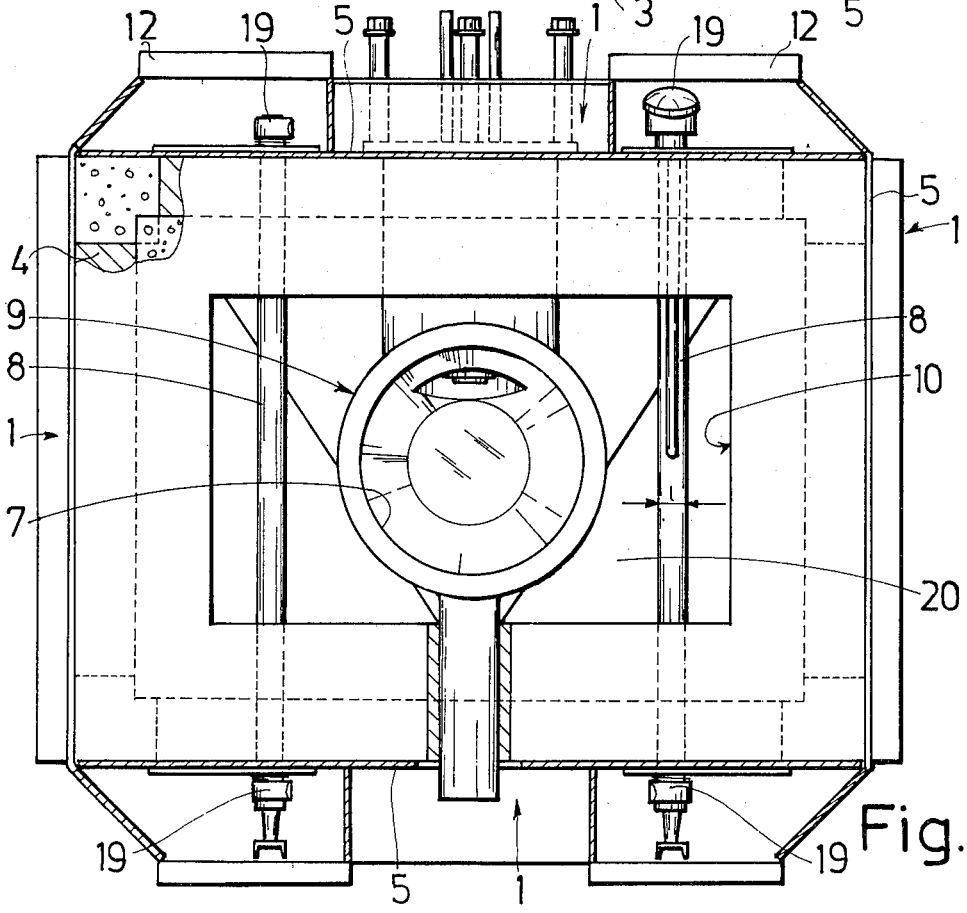
Figure 6:
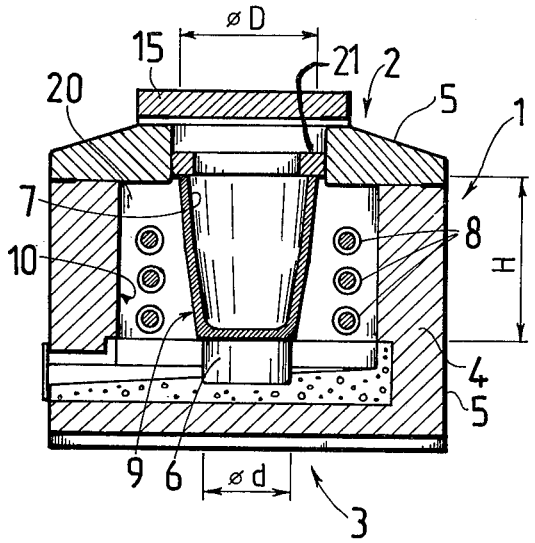

FIG. 3 shows the melting and casting means of FIGS. 1 and 2 together with its tilting mechanism, in elevational view, FIG. 4 shows another furnace of the invention in elevational view and sectioned, FIG. 5 shows in top view the same furnace as FIG. 4, and FIG. 6 shows a third means of the invention in elevational view and sectioned.

The melting and casting means of the invention, presented in FIGS. 1–6, comprises the heating chamber 20, which is confined by the side walls 1, top wall 2 and bottom wall 3 in the lateral and height directions. The walls are enclosed within a steel shell. In the heating chamber has been placed on crucible support base 6, a crucible 7 mounted on this base, and a minimum of three heating elements 8 with electrical leads 19, these said heating elements being mounted in the chamber between the inner walls and the crucible without any physical contact between the elements and the crucible. As taught by the invention, the heating elements 8 are silicon carbide heating elements and they are intended to raise the temperature of the crucible 7 to between 1100° and 1650° C. to the purpose of melting and casting copper and copper alloys. Further, according to the invention, the thermal lagging material 4 in the walls 1 consists mainly of aluminum and silicon oxide fibres. Further, according to the invention, the heating elements have been so disposed in the chamber 20 that the distance between element centre and the outer surface 9 of the crucible is 2 to 4 times the dimension 1, where 1 refers to the diameter of the heating element.

The melting and casting means presented in FIGS. 1–3 has in the main the shape of a parallelepipedon, the outer surface of the top wall 2 constituting an upwardly projecting, partly convex surface, upon which the cover 15 has been placed. The side walls 1 define between themselves an equally mainly parallelepipedon-shaped, elongated space wherein the crucible 7 has been placed upon the stand 6. The crucible 7 projects partly into the top wall 2, whereby a tight juncture is formed between the crucible and the top wall and the metal vapours cannot penetrate into the heating chamber. A packing 21 has been mounted between the mouth of the crucible, opening upwards, and the top wall 2, the packing being made of e.g. the same elastic fibre material as the insulating material 4.

The length to breadth ratio of the parallelepipedon-shaped heating chamber 20 is approximately 1.6 to 1.7. The centerline distance of the four topmost elements from the outer surface 9 of the crucible 7 on both sides is between 2.7 and 2.8 times the element diameter, and the equivalent distance of the lowermost elements is 3.1 times the element diameter. All twelve elements, six on either side of the crucible, have a distance from the shorter side walls of the chamber 20 which is consistently 2.8 times the element diameter.

The elements 8 are circular in cross section and they are parallel and mounted underneath each other in two parallel rows, aligned along the shorter side walls of the chamber, at right angles to the longer side walls of the chamber. The maximum power rating of the elements 8 is about 8.4 kW, whereby the maximum power rating of the whole apparatus is about 100 kW. The holding capacity of the apparatus is 500 kg of copper or 150 kg of aluminium. The chamber shown in FIGS. 1–3, confined by the walls 1–3 with its crucible and elements has been pivotally attached to the supporting and frame structures 11 supporting the apparatus with the aid of a horizontal axle 13 parallelling the longer side walls of the chamber. The apparatus furthermore comprises a hydraulic cylinder 14 pivotally attached to the frame 11 and to the chamber 20 for the tilting of the heating chamber and of the crucible belonging thereto, carried by the frame 11, towards the draining aperture 16.

When using the apparatus, one opens the cover 15 and partly fills the crucible 7 with metal to be melted, then the cover is closed and the electric current of the resistances 8 is switched on to begin to heat the elements. From the elements, the heat is transmitted mainly by radiation and partly by convection to the crucible and to the metal placed therein, and partly to the inner surface of the side walls 1. Owing to the placement of the elements 8 at a certain distance from the crucible and at a certain distance from the side walls 1, the heat is transmitted to the crucible 7 and to the side walls 1 uniformly and without any temperature peaks and/or minima causing high thermal stress. After the metal which is being melted has reached the desired temperature, pressurized liquid is conducted into the cylinder 14 and this causes the apparatus to be tilted towards the draining aperture 16 to the purpose of pouring the molten metal in a mould, for instance. On conclusion of the pouring, the pressure in the hydraulic cylinder 14 is reduced by the aid of a regulator (not depicted), whereby the chamber 20 with its crucible 7 descends into its original upright position.

Since the elements 8 pierce the longer opposed walls of the chamber 20 and find support in mounting tubes encircling the elements and which have been passed through the walls (these tubes being visible in FIG. 1 as a solid ring around the slant-hatched round elements), shocks acting on the apparatus cause minimum mechanical stressing of the elements, thanks to the supporting of their both ends. Moreover, the fibrous insulating substance 4 damps the shocks to which the elements are subjected, arising as the pouring apparatus vibrates in connection with the pouring movements. In the apparatus shown in FIGS. 1–3, the heating elements are located horizontally and spaced at a given distance from the bottom of the chamber, the distance of the lowermost elements being about 5 times the element diameter. Hereby it is ensured that metal running on the floor of the chamber from a partly broken crucible for instance cannot damage the elements, not even those which are located lowest.

The length to breadth ratio of the heating chamber 20 of the apparatus shown in FIGS. 4–5 is about 1.6. In the chamber 20 three heating elements have been placed in a vertical row on either side of the crucible in horizontal position and parallel to the shorter side walls of the chamber. The centerlines of the topmost elements have a distance from the outer surface of the crucible about 2.7 times the element diameter, the corresponding distancing of the centremost elements is about 2.9 times the element diameter and the equivalent distance of the lowermost elements is about 3.4 times the element diameter. The centerline distance of the elements from the inner surface of the chamber's shorter side walls is about 2.3 times the element diameter.

Each element is distanced from the next element above or below (centerline to centerline) about 3.3 times the element diameter. The distance of the lowermost elements from the chamber bottom is about 4.5 times the element diameter.

The maximum rating of the elements in the apparatus depicted in FIG. 4–5 is about 8.3 kW, that is the whole apparatus has a maximum rating about 50 kW. The holding capacity of this apparatus is about 300 kg of copper or 90 kg of aluminium.

The melting and casting apparatus illustrated in FIG. 4–5 is meant for the horizontal casting process. The draining aperture 6 of the crucible 7 has been disposed close to the bottom of the crucible and it is indended to be furnished with chill mould and/or cooling means. Furthermore, the crucible 7 of the melting and casting means of FIGS. 4 and 5 comprises another draining aperture 6' for emptying the crucible. The bottom wall 3 and roof wall 2 have been partly made of a pouring compound in order to gain adequate strength. The aperture of the crucible 7 has been packed to the top wall 2 with the aid of a packing 21. In FIG. 6 has been shown a third apparatus according to the invention, in elevational view and sectioned longitudinally. The chamber is shaped like a parallelepipedon and the ratio of its longer side to the shorter side is about 1.6. The apparatus comprises a total of six heating elements placed in horizontal position, one upon the other in two rows parallel to the chamber's shorter sides on either side of the crucible. The distance of the elements' centerlines from the outer surface is about 2.4 times the element diameter as regards the topmost elements, about 2.8 times the element diameter as regards the centremost elements, and about 3.3 times the element diameter as regards the lowermost elements. The distance of the elements' centerlines from the inner surfaces of the chamber's shorter side walls is about 2.1 times the element diameter; each element's centerline is distanced from that of the element above/below by about 2.8 times the element diameter, and the centerlines of the lowermost elements have a distance from the bottom of the chamber about 3.2 times the element diameter. The maximum rating of the elements is about 14 kW each and the maximum power rating of the whole apparatus is about 85 kW. The holding capacity of the apparatus is about 1000 kg of copper or 300 kg of aluminium.

The operation of the apparatus of FIG. 6, as regards metal melting and heating of the apparatus, is similar to that revealed in the foregoing with reference to the apparatus of FIGS. 1-3. Furthermore, the apparatus is intended to be kept stationary mostly; merely the crucible 7 being lifted out from within the chamber 20 through the chamber 5 in connection with the casting process; the lifting means are of conventional type and have not been depicted.

EXAMPLE 1

Of casting apparatus as shown in FIGS. 1-3, the types displayed in Table 1 were manufactured.

TABLE I

| Type | Dimensions, in mm D | d | H | Number of elements | Holding capacity, kg Cu | Al | Total power, kW | Weight, kg |
|---|---|---|---|---|---|---|---|---|
| T-50 | 305 | 265 | 400 | 9 | 60 | 20 | 28 | 950 |
| T-200 | 380 | 355 | 580 | 9 | 200 | 60 | 45 | 1500 |
| T-500 | 445 | 385 | 990 | 12 | 500 | 150 | 100 | 2600 |
| T-1000 | 615 | 560 | 945 | 12 | 1000 | 300 | 170 | 3300 |
| T-2000 | 670 | 650 | 1200 | 18 | 2000 | 600 | 250 | 4000 |

In the table:
D = crucible diameter, in its upper part
d = crucible diameter at its bottom
H = crucible height

EXAMPLE 2

Of casting apparatus as shown in FIG. 6, the types displayed in Table II were manufactured.

TABLE II

| Type | Dimensions, in mm D | d | H | Number of elements | Holding capacity, kg Cu | Al | Total power kW | Weight, kg |
|---|---|---|---|---|---|---|---|---|
| S-50 | 305 | 205 | 375 | 9 | 80 | 25 | 28 | 700 |
| S-200 | 380 | 265 | 480 | 9 | 200 | 60 | 45 | 1250 |
| S-300 | 440 | 295 | 540 | 6 | 300 | 90 | 50 | 1400 |
| S-500 | 510 | 325 | 650 | 9 | 500 | 150 | 75 | 1700 |
| S-1000 | 615 | 355 | 700 | 6 | 1000 | 300 | 85 | 2000 |

In the table:
D = crucible diameter, in its upper part
d = crucible diameter at its bottom
H = crucible height The mutual spacing of the heating elements, the distance of the centerline of each horizontal heating element from that of the parallel heating element located above/below is for instance 2-4 times the element diameter; in the case depicted in FIGS. 1-3 the said distance is 2.6 times the element diameter, in the apparatus presented in FIGS. 4-5 it is 3.4 times the element diameter, in the embodiment shown in FIg. 6 it is 2.8 times the element diameter and in the embodiment displayed in Example 2, Type T-2000, about 2.2 times the element diameter. Hereby, owing furthermore to the given distance of the elements from the outer surface of the crucible and from the wall surface of the heting volume's shorter side wall, the heat will radiate uniformly from the elements to the surface of the crucible, that is, the surface temperature of the crucible is substantially uniform. Furthermore, the heat radiated from the elements to the inner surface of the heating volume's shorter walls will likewise have a mainly uniform distribution over the said wall surfaces. Thereby the temperature differences between different points on the outer surface of the crucible, and likewise between various points on the inner surfaces of said chamber walls, will be the lowest possible and the thermal stresses inmposed on said surfaces are minimized.

If the spacing of the heating elements from the crucible were less than has been specified in the foregoing, the surface temperature of the crucible would be higher owing to the stronger convection and radiation, and this would impose a high thermal stress on the crucible. The consequence would be a reduced service life of the crucible. A longer distance of the elements from the crucible's outer surface would result in lower heat convection and radiation, which would impair the heat economy of the apparatus.

In case the distance of the heating elements from the shorter side walls of the heating chamber were shorter than has been specified above, this would increase the amount of heat transferring by convection and radiation to the said wall surfaces and it would raise the temperature of the wall surfaces. The consequence hereof would be impaired heat economy and high stresses on the side walls, which would imply high operating costs and a shorter service life of the walls. In the distance of the elements from said side walls were greater than specified, this would result in unreasonable size of the heating chamber, particularly would the distance from the heating elements of the shorter side walls, and thereby from the crucible, increase. This would imply a larger size as well as surface area of the outer walls of the apparatus, which would add to the heat transfer to ambient space, that is increase the heat losses, with increasing transmission area. The result hereof would be impaired heat economy of the apparatus and higher costs.

The quantity of constituents in the mineral fibre used for thermal lagging may vary considerably. The combined quantity of $Al_2O_3$ and $SiO_2$ is 50-100% by weight; the quantity of $Al_2O_3$ may be 0-100% by weight; e.g. over 40% by weight, such as 40-60% by weight; the quantity of $SiO_2$ may be 0-100% weight, e.g. over 40% by weight, such as 40-60% by weight; other additives and impurities may be present in the fibres provided the impurities cause no corrosion or other damage to the crucible, elements or to the furnace structures—iron compounds for instance are often harmful to the elements and furnace structures.

The thermal conductivity of the lagging material 4 is, for instance, 0,1-0,3 kcal/mh° C. in the outer layer of the fibrous insulating material - and respectively in the inner layer nearest the crucible at about 400° C. and respectively at 1200° .

The lagging 4 consists of mineral fibre, such as "Triton kaowool" or "Fiberfax" containing the following constituents:

| | |
|---|---|
| $Al_2O_3$ | 43-70% by weight |
| $SiO_2$ | 20-54% by weight |
| $Fe_2O_3$ | Traces |
| $TiO_2$ | Traces |
| MgO | Traces |
| CaO | 0,01-1,0% by weight |
| $Na_2O$ | 0,1-2,0% by weight |

The efficiency of the apparatus may be improved and the quantity of lagging material required may be reduced by placing a passive reflector between the shorter side walls of the chamber and the heating elements to reflect the heat to the crucible.

It is possible to attach to the apparatus of the invention, ancillary pieces of equipment known in themselves in connection with melting and casting apparatus, such as a thermostat with temperature pick-up (visible in FIG. 4, above the aperture 16 and the upper heating element), pouring means, aperture closing means, etc.

The embodiment examples are meant to illustrate the invention, without restricting it in any way whatsoever.

We claim:

1. A melting and casting apparatus, comprising a heating chamber (20) with side walls (1), a top wall (2), a bottom wall (3) all made of well heat-insulating material (4), a steel shell (5) encircling said heating chamber; a crucible stand (6) disposed within said chamber; a crucible (7) placed on said stand; a minimum of three heating elements (8) installed in said chamber and provided with electric leads (19), said heating elements being disposed within said chamber between said heating elements and said crucible without any physical contact between said heating elements and said crucible; characteristized in that the heating elements (8) are silicon carbide heating elements for heating the crucible to a temperature between 1100 and 1650 degrees Centrigrade for the melting of copper and copper alloys, the well heat-insulating material (4) consists mainly of aluminium oxide and silicon oxide fibres, and the heating elements are so located in the heating chamber that the distance from the centre of the elements to the outer surface (9) of the crucible is 2–4 times 1, where 1 stands for the diameter of the heating element.

2. Apparatus according to claim 1, characterized in that the spacing of the heating element (8) from the inner wall (10) of the heating chamber (20) parallelling the heating element is 2–4 times 1, where 1 refers to the diameter of the heating element.

3. Apparatus according to claim 1, characterized in that a packing (21) has been mounted between the mouth of the crucible (7) opening upwards and the top wall (2) for preventing the release of metal vapours into the heating chamber 20.

4. Apparatus according to claim 1, characterized in that the heating chamber (20) has substantially the shape of an elongated parallelepipedon in which the crucible has been substantially centrally placed, that the heating elements (8) pierce the opposite, longer walls (10) of the chamber, parallelling the shorter walls (10), and are located above each other in two vertical rows on either side of the crucible between the shorter walls of the chamber and the crucible, the distance of the centerlines of the elements from the outer surface of the crucible being 2.3–3.5 times the element diameter.

5. Melting and casting apparatus according to claim 4, characterized in that the distance of the centerlines of the elements from the shorter walls of the chamber (20) is 2–3 times the element diameter.

6. Melting and casting apparatus according to claim 4, characterized in that the distance of the centerlines of the lowermost elements (8) from the bottom (3) of the chamber (20) is 3–5 times the element diameter.

7. Melting and casting apparatus according to claim 4, characterized in that the distance of the centerline of each element (8) from the centerline of the element which is closest in vertical direction is 2–4 times the diameter of the element.

8. Apparatus according to claim 1, characterized in that the thermal conductivity of the fibrous insulating material (4) is 0.1–0.3 kcal/mh° C. in the outer layer and correspondingly in the inner layer of the insulating material at 400° C. and correspondingly 1200° C.

* * * * *

UNITED STATES PATENT AND TRADEMARK OFFICE

CERTIFICATE OF CORRECTION

PATENT NO. : 4,238,635

DATED : December 9, 1980

INVENTOR(S) : Matti Saarivirta et al

It is certified that error appears in the above-identified patent and that said Letters Patent are hereby corrected as shown below:

In column 7, lines 21-22, that portion of Claim 1 reading "between said heating elements and said crucible" should read -- between said side walls and said crucible --.

Signed and Sealed this

*Sixteenth* Day of *June 1981*

[SEAL]

*Attest:*

RENE D. TEGTMEYER

*Attesting Officer*

*Acting Commissioner of Patents and Trademarks*